United States Patent [19]

Corron et al.

[11] 4,204,301

[45] May 27, 1980

[54] STRAND HANDLING SYSTEM AND METHOD THEREFOR

[75] Inventors: Donald C. Corron, Piedmont; Glen Tallent, Jr., Greenville, both of S.C.

[73] Assignee: Greentex Incorporated, Greenville, S.C.

[21] Appl. No.: 900,194

[22] Filed: Apr. 26, 1978

[51] Int. Cl.[2] ..... D02G 1/20

[52] U.S. Cl. ..... 28/248; 28/258; 28/281; 28/290; 28/266

[58] Field of Search ..... 28/258, 266, 281, 289, 28/290, 250, 251, 271, 283, 248

[56] References Cited

U.S. PATENT DOCUMENTS

| | | | |
|---|---|---|---|
| 2,302,790 | 11/1942 | Modigliani | 28/283 |
| 2,333,279 | 11/1943 | Truesdail . | |
| 3,408,716 | 11/1968 | Tradewell | 28/281 |
| 3,526,024 | 9/1970 | Fay . | |
| 3,616,503 | 11/1971 | Mattingly . | |
| 3,644,968 | 2/1972 | Elliott et al. . | |
| 3,659,439 | 5/1972 | Tindall . | |
| 3,729,831 | 5/1973 | Kosaka et al. . | |
| 3,773,453 | 11/1973 | Hino et al. | 28/281 X |
| 3,780,405 | 12/1973 | Izawa et al. . | |
| 3,785,017 | 1/1974 | Jacob et al. . | |
| 3,805,407 | 4/1974 | Fleissner | 28/281 X |
| 3,833,975 | 9/1974 | Cahnman et al. . | |
| 3,854,177 | 12/1974 | Breen et al. . | |
| 3,866,279 | 2/1975 | Kennedy | 28/281 |
| 3,885,278 | 5/1975 | Whitaker . | |
| 3,902,644 | 9/1975 | Bous | 28/251 X |
| 3,907,187 | 9/1975 | Collausig . | |
| 3,916,651 | 11/1975 | Carruthers . | |
| 3,929,542 | 12/1975 | Gehrig et al. | 28/271 X |
| 3,936,918 | 2/1976 | List et al. | 28/281 |
| 3,944,166 | 3/1976 | Hermanns | 28/290 X |
| 3,945,545 | 3/1976 | Bacro | 28/289 X |
| 3,965,548 | 6/1976 | James et al. . | |
| 4,019,228 | 4/1977 | Ozawa et al. . | |

FOREIGN PATENT DOCUMENTS

| | | | |
|---|---|---|---|
| 2345299 | 3/1974 | Fed. Rep. of Germany | 28/281 |
| 2616922 | 10/1977 | Fed. Rep. of Germany | 28/281 |
| 2715769 | 10/1977 | Fed. Rep. of Germany | 28/281 |
| 1602027 | 11/1970 | France | 28/289 |
| 46-23336 | 7/1971 | Japan | 28/251 |

*Primary Examiner*—Robert Mackey
*Attorney, Agent, or Firm*—Luke J. Wilburn, Jr.; Wellington M. Manning, Jr.

[57] ABSTRACT

Method and apparatus for handling textile yarn strands in which textile yarn strands subjected to a heat treating operation are continuously directed from the heat treating apparatus by a stream of air through an oscillating tube onto a moving conveyor belt to deposit and accumulate the yarn strand thereon in a substantially tensionless condition for cooling. The yarn strand is removed from the accumulated yarn on the belt surface in a direction generally parallel to the surface and to the direction of movement of the accumulated yarn thereon to minimize tangling of the yarn, and the strand is subjected to a cooling air stream directed oppositely to its direction of movement to detangle the same prior to collection on a package. The speed of yarn package take up is controlled by means of a photoelectric sensing device located above the conveyor belt to sense the amount of yarn accumulated on the belt, and to ensure that a predetermined amount of yarn is maintained on the belt during the cooling operation.

12 Claims, 4 Drawing Figures

STRAND HANDLING SYSTEM AND METHOD THEREFOR

BACKGROUND OF THE INVENTION

Various different methods and types of apparatus have heretofore been utilized for heat treating thermoplastic synthetic textile yarns to cause the yarn to bulk, to reorient molecular orientation of the molecules of the polymer, or the like. Likewise, various and sundry techniques have been employed for handling the treated yarns subsequent to a particular yarn treating process.

With yarn handling systems where adequate tension is maintained on the strand during processing, there is little likelihood of tangling of the strands, or other misorientation of the strands such as to cause physical problems with the strands during later handling or processing.

In an environment, however, where the yarn is being handled under substantially tensionless conditions such as in bulking units of the type disclosed in U.S. Pat. Nos. 3,408,716 to Tradewell and 3,866,279 to Kennedy, subsequent handling of the bulked yarn after exiting the heat treating unit has been problematical. To maintain the tensionless conditions, it is of course, necessary to accumulate the yarn in such fashion that take-up for production of a yarn package will not counteract the operating conditions and produce detrimental effects on the yarn being bulked or otherwise heat treated. Prior art attempts to handle the bulked yarn subsequent to the tensionless heat treating operation include conical or other shaped baskets where the yarn is randomly deposited in one end and removed at an opposite end, or where, after being deposited into the basket the yarn is continuously withdrawn at a slower rate than feeding. Yarn exiting tensionless heat treating units has also been deposited into J boxes where the yarn generally follows a sinuous path along a smooth surface in the shape of a J entering at an upper end of the J and exiting at a lower end of the J.

In both of the above yarn handling systems, particularly where bulked yarn is being handled, problems have been encountered, almost to the extent of defeating commercialization of certain heat treating, bulking processes. In particular, the random deposition of the heat treated yarns into the accumulator whatever its shape, has caused excessive tangling. Upon removal of the yarn from the prior art accumulators where a single strand is likely to become sufficiently entangled with an adjacent strand, often more than a single yarn strand is removed. The strand is then broken during subsequent processing, either immediately or downstream, and/or an improper yarn package is produced, both of which are costly and may lead to a second quality product.

The apparatus and method of the present invention represent a distinct improvement over the prior art, in that the aforementioned problems are virtually if not completely, alleviated. An improved method of operation is thus available while realizing improved process efficiency and the production of an improved product. The particular combination of elements and method steps according to the present invention are not believed to be taught or suggested by the prior art.

SUMMARY OF THE INVENTION

It is an object of the present invention to provide an improved strand handling system.

Another object of the present invention is to provide a system for the handling of a yarn previously bulked under tensionless conditions from the point of removal of the processing unit to the point of production of the yarn package in such fashion that undue yarn entanglement is avoided.

Still another object of the present invention is to provide an improved method for the handling of a textile yarn during and subsequent a yarn heat treating process where the yarn is handled under tensionless conditions.

Yet another object of the present invention is to provide an improved method for the handling of a synthetic thermoplastic textile yarn after the yarn has been bulked and until the yarn is taken up on a yarn package.

DESCRIPTION OF THE PREFERRED EMBODIMENTS

Figure 1:
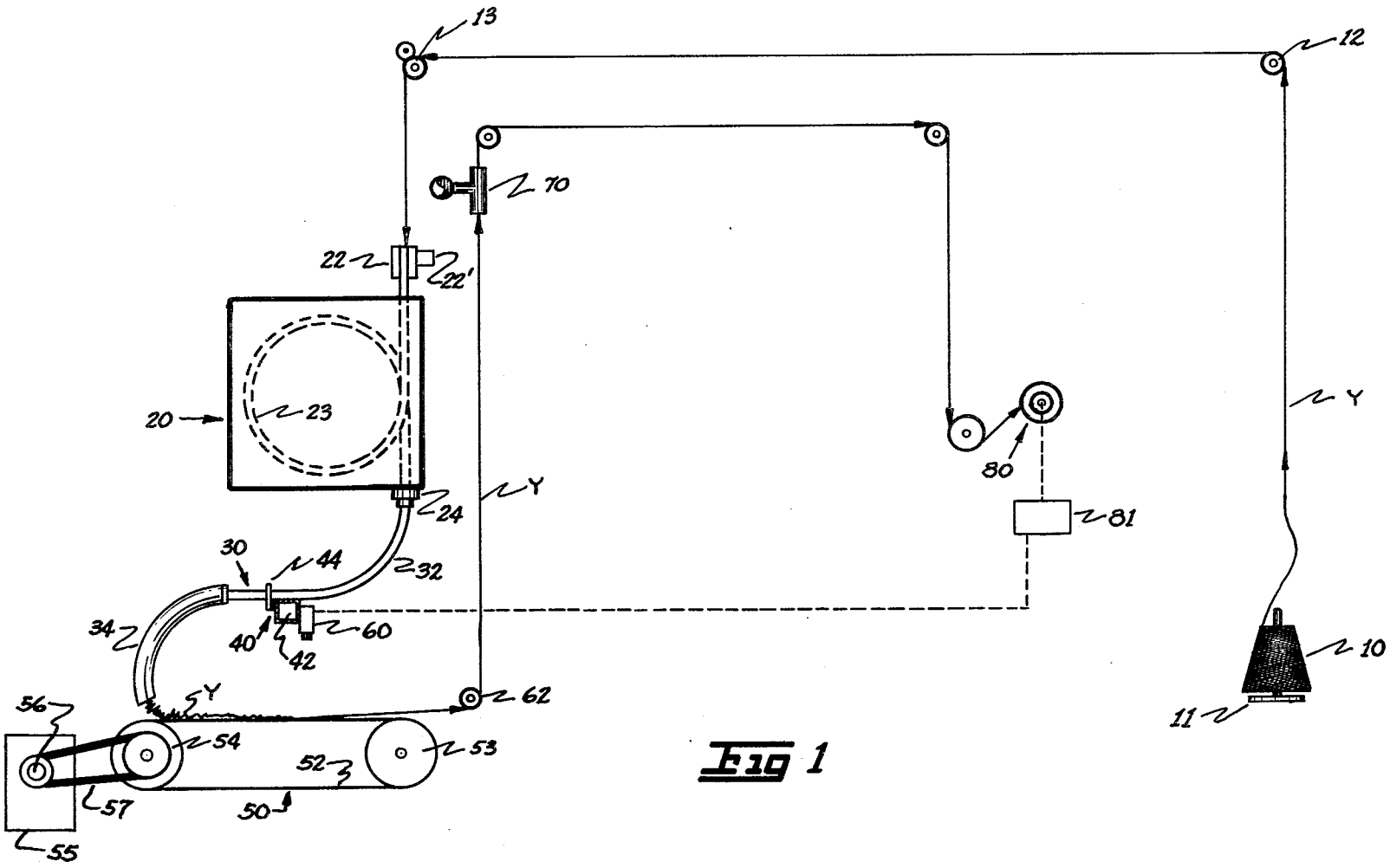
FIG. 1 is an elevational schematic view of a strand handling system according to teachings of the present invention.

Making reference to the Figures, preferred embodiments of the present invention will now be described in detail. In FIG. 1, a schematic of a yarn handling system embodying teachings of the present invention is illustrated where a package of yarn 10 is received on suitable support 11 and a strand of yarn Y is removed therefrom over suitable guide means 12 by a yarn feed means schematically illustrated as 13. A yarn heat treating unit generally indicated as 20 is located adjacent yarn feed means 13 and receives positively fed yarn. The yarn is bulked or otherwise heat treated under generally tensionless conditions.

A preferred heat treating unit 20 for use in conjunction with the system of the present invention is one in which a tubular nozzle 22 is provided at the entrance to the unit with pressurized air being introduced at nozzle 22 through air inlet 22' to heat yarn Y and transport yarn through unit 20. Internally of unit 20 is a convoluted conduit 23 which defines the yarn path. Conduit 23 is generally immersed in a heat exchange fluid (not shown), or any appropriate heat transfer medium, or is otherwise adapted to transfer a predetermined amount of heat to yarn Y as yarn Y is transported therethrough. While the particular structure and technique of the heat treating unit does not, per se, form a part of the present invention, reference is made to U.S. Pat. Nos. 3,408,716 to Tradewell and 3,866,279 to Kennedy, as exemplary and preferred types of systems that might be employed in conjunction with the overall apparatus of the present invention.

An oscillatable yarn directing means generally indicated as 30 is associated with heat treating unit 20, preferably by a quick coupling unit 24 or the like. Yarn directing means 30 is comprised of an elongated tubular element that is configured to properly lay yarn on a moving conveyor. One such configuration is illustrated in FIG. 1, which configuration is preferred for heavy denier yarn, and includes a first tubular section 32 and an outlet nozzle section 34. Low denier yarns, as discussed hereinafter, do not require the nozzle section 34 whereby only an appropriate length of tubular element 32 is utilized.

Figure 3:
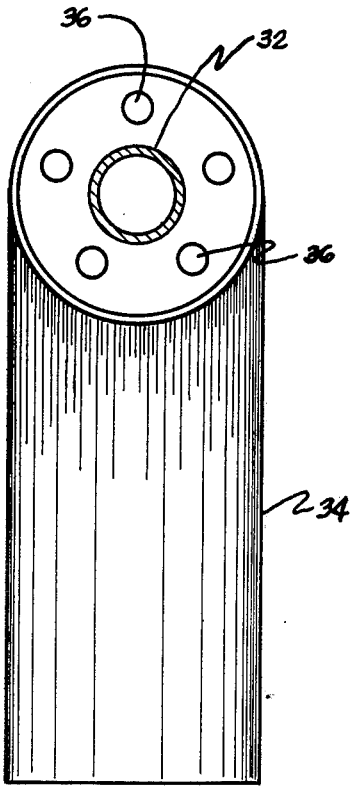
FIG. 3 is a top view of an embodiment of a yarn distributing means according to teachings of the present invention.

In the preferred heat treating unit 20, air under pressure transports the yarn through the unit. Preheated air at a pressure of approximately 28 pounds per square inch is injected into entrance nozzle 22 to preheat the yarn and transport same through unit 20. As the yarn exits the heat treating unit, at the terminal end of the yarn directing means 30 according to the present invention, air pressure should be approximately nil to avoid undue stress on the yarn or entanglement of the yarn. With a low denier yarn, less air is needed for transport and yarn directing means 30 may include only an appropriate length of tubular section 32. Heavy denier yarn, however, requires a greater quantity of air and nozzle section 34 is employed (See FIG. 3) with a plurality of orifices around its connection to tube 32 to dissipate air turbulance and pressure.

Yarn directing means 30 is associated intermediate its length with a traverse mechanism generally indicated as 40. In particular, a yoke 44, as better illustrated in FIG. 2, receives an intermediate portion of yarn directing means 30 (along tubular section 32 in FIG. 1) with yoke 44 being secured to a bar 42 (FIG. 2) that is suitably mounted for horizontal reciprocation on the frame of the heat treating unit and is acted upon by a suitable means schematically illustrated as 45, such as a cam arrangement. Specific details of the oscillating means 45 is not shown since same is conventional in the art. Operation of cam means 45 produces a horizontal oscillating movement of yoke 44 which in turn carries the terminal end of yarn directing means 30 therealong to properly lay the yarn in a sinuous path on a moving conveyor means generally indicated as 50.

Figure 2:
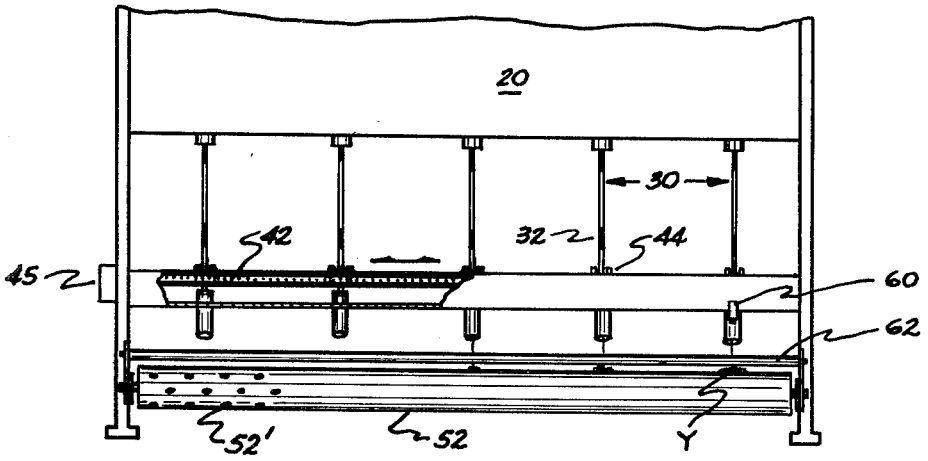
FIG. 2 is a partial frontal elevational view of strand handling apparatus according to teachings of the present invention.

Conveyor means 50 preferably, includes an endless belt 52 having a series of perforations 52' thereacross (See FIG. 2). Belt 52 is supported by a pair of rolls 53, one of which is provided with an appropriate pulley 54 which is in driving connection with a power source, such as motor 55, via a motor pulley 56 and a drive belt 57. Motor 55 may also afford a power source for cam means 45. Hence, with conveyor means 50 moving, yarn Y is deposited thereon in sinusoidal fashion by oscillating yarn directing means 30. Deposition of yarn Y onto the conveyor means permits yarn to cool by the passage of ambient air through perforations 52' in conveyor belt 52. The yarn is removed from the conveyor belt 52 around a guide means 62 which is positioned at a location adjacent conveyor belt 52. From guide means 62, the treated yarn is subjected to a detangling-cooling unit generally indicated as 70, and then taken up on an appropriate package at take up means 80.

Figure 4:
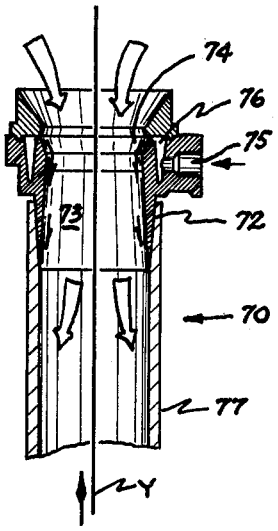
FIG. 4 is a cross sectional view of a yarn detangle-cooling unit according to teachings of the present invention.

Yarn detangling-cooling unit 70 is particularly illustrated in FIG. 4. The device, per se, does not form a part of the present invention, and preferably is a modified TRANSVECTOR air flow amplifier manufactured by Vortec Corporation, Cincinnati, Ohio. Unit 70 includes a housing 72 having an opening 73 therethrough with a throat or restricted portion 74 therealong. Air is introduced at a pressure in the range of about 15-20 pounds per square inch into an annular cavity 76 and through a port 75 and into passageway 73 at throat 74. The direction of air flow along passage 73 is opposite the direction of yarn movement therethrough, whereby the air both cools the yarn and assists in detangling same. An extension 77 to housing 72 permits better action of the air on yarn Y and is preferred.

As shown in FIGS. 1 and 2, a yarn detection system 60, such as a photocell is preferably positioned above conveyor belt 52 to detect the absence or presence of yarn on belt 52 and control the speed of take up means 80 responsive thereto via operative association with a power means 81 for take up 80 as schematically illustrated.

In operation, a yarn Y is positively fed into nozzle 22 by feed roll 13 where it encounters pressurized air that has been preheated to a predetermined temperature for the particular yarn. Yarn Y is thus transported by the air through convoluted conduit 23 where further heat exchange or bulking occurs on the tensionless yarn. After passing through the heating unit 20, the relaxed yarn passes through the yarn directing means 30 which is being oscillated in a horizontal direction, and is properly deposited in a sinusoidal arrangement onto the moving conveyor belt 52. As the conveyor belt 52 moves, yarn is accumulated thereon, and is withdrawn therefrom via guide 62, in a direction generally axial with respect to yarn movement along conveyor means 50. In a preferred arrangement, yarn Y passes partially around guide element 62 and upwardly to yarn cooling and detangling unit 70 where it encounters an opposite flow of air to further assist in detangling of the yarn prior to production of the yarn package. Certainly as mentioned above, the yarn being treated in heat treating unit 20 is in a generally tensionless state and to continue to provide the tensionless or relaxed state, it is necessary to coordinate the speed of conveyor means 50 and yarn take up 80 with the input feed of yarn Y into heat treating unit 20.

As may be seen in FIG. 2, the apparatus of the present invention, in a most preferred arrangement, includes a plurality of individual units that are located in a row along a suitable support frame. One conveyor means 50 may be employed to receive yarn from a plurality of yarn directing means 30, all of which are simultaneously oscillated to thereby provide a plurality of sinusoidal yarn deposits spaced along the width of conveyor belt 52.

While operating conditions of the apparatus and process according to the present invention may vary from plant to plant, depending upon the particular needs and particular yarn being processed, a typical operation is set forth below for the bulking of 1850 denier, 2-ply filament nylon, 15 denier per filament. A production speed of 170 yards per minute is employed with the yarn bundle entering the bulking unit 20 at nozzle 22 where it is preheated with air at 265 degrees F. and 28 psig. The yarn bundle is then transported through conduit 23 where it is radiantly heated to a temperature of approximately 220 degrees F. Air pressure at the exit end of the yarn directing means 30 approaches 0 psig. After exit of the bulked yarn from the heat treating unit, the yarn is deposited via the oscillating yarn direction means 30 onto perforated conveyor belt 52 with the conveyor speed set to avoid disruption of the tensionless conditions of the yarn. The end of bulked yarn is then passed under the guide 62 and upwardly through the detangling-cooling device 70 where air is introduced into the device at 15 pounds per square inch pressure. The yarn is then taken up on a winder operating at a speed slightly faster than the equivalent yards per minute speed that the yarn is delivered at the belt level.

Yarn take-up means 80, normally a winder, is controlled by a conventional motor system 81. In a preferred arrangement, the yarn take-up means of the present invention operates at two speeds, low and high, and is controlled in conjunction with photocells 60 located above conveyor belt 52, slightly downstream of the point where yarn is deposited thereon. Upon sensing the presence of yarn for some predetermined period of time, the photocell 60 signals the drive means 81 for the winder 80 to operate at high speed. Likewise upon detecting the absence of yarn for a predetermined period of time, photocell 60 signals a return of motor 81 to slow speed. Yarn take-off from conveyor belt 52 is thus controlled to avoid disruption of the tensionless conditions and to ensure proper operation of the process.

What we claim is:

1. An improved yarn strand handling apparatus comprising yarn heat treating means; yarn directing means associated with a strand exit side of said yarn heat treating means for receiving a yarn strand therefrom and directing the strand under substantially tensionless condition in a predetermined pattern; yarn conveyor means located beneath said yarn directing means and having a surface for continuously receiving and accumulating the yarn strand in said predetermined pattern under substantially tensionless condition for cooling; guide means located adjacent the discharge end of said yarn conveyor means for removing the yarn strand from the surface of the yarn conveyor means in a direction generally parallel to said yarn conveyor means surface and generally axially with respect to movement of the accumulated yarn thereon to reduce tendency of the strand to tangle during removal from said conveyor surface; yarn detangling means for receiving the yarn strand from said guide means; and yarn take up means downstream of said yarn detangling means for forming the yarn strand into a package.

2. The apparatus as defined in claim 1 wherein the yarn heat treating means is a chamber having a convoluted conduit provided therein to receive yarn and heat treat same in substantially tensionless condition during yarn passage therethrough.

3. The apparatus as defined in claim 2 wherein said yarn directing means is a tubular conduit secured to the yarn strand exit of said heat treating means and terminating at a position immediately adjacent and above said yarn conveyor means.

4. The apparatus as defined in claim 3 wherein said yarn directing means is associated with means for oscillating same in a horizontal direction to deposit yarn on said conveyor means in a sinusoidal fashion.

5. The apparatus as defined in claim 1 wherein the conveying means comprises an endless conveyor belt, said belt being perforated to permit cooling of yarn deposited thereon, and means for operating said conveyor belt at a speed to retain generally tensionless conditions on the yarn whereby the yarn is deposited onto the conveyor belt in a relaxed state.

6. The apparatus as defined in claim 1 wherein the yarn detangling device comprises a housing having an air supply associated therewith, said air being directed in a direction opposite the travel of yarn therethrough, whereby the air encountering the yarn aids in detangling and cooling same.

7. Improved apparatus for cooling and collecting heat treated yarns on individual yarn strand packages with minimum tensioning and tangling of the yarns during cooling and collection; comprising yarn heating means including means defining a yarn path for heating a yarn moving therealong, means for conveying a yarn strand along said path defining means from entrance to exit end thereof in a stream of air; an elongate tubular member movably attached to and communicating with said exit end of said path defining means for continuously receiving the yarn strand therefrom and directing the strand therethrough under influence of said air conveying means; a moving conveyor having a generally flat horizontally disposed surface positioned immediately adjacent and below the exit end of said tubular member for receiving yarn therefrom; means for reciprocating said tubular member in a direction transverse to the direction of movement of said conveyor to continuously discharge the yarn strand from the exit end of said tubular member onto the conveyor surface in a generally sinuous path and under substantially tensionless conditions to permit the yarn to cool thereon; yarn guide means disposed adjacent the surface of said conveyor for removing the yarn strand from the surface of the conveyor in a direction generally parallel to the surface and generally axially with respect to movement of the accumulated yarn thereon to minimize tangling of the yarn during its removal from the conveyor surface; yarn detangling means downstream of said guide means for directing a cooling stream of air in a direction opposite the direction of movement of said yarn strand to further cool and detangle the strand; and yarn take up means downstream of said yarn detangling means for forming the yarn strand into a package.

8. Apparatus as defined in claim 7 including means for controlling the rate of take up of said yarn strand by said yarn take up means in response to a desired accumulation of yarn on said conveyor for cooling.

9. Apparatus as defined in claim 8 wherein said means for controlling the rate of take up of said yarn strand comprises a yarn detector located above said moving conveyor and operatively associated with said yarn take up means to vary the speed of removal of the yarn from said moving conveyor surface.

10. Apparatus as defined in claim 7 wherein said means for reciprocating said tubular member includes a support bar having a yoke secured thereto, and means for reciprocating said bar in a generally horizontal direction, the tubular member being received in said yoke to reciprocate with said support bar.

11. An improved process for handling heat treated yarn strands comprising the steps of:

(a) continuously passing a yarn strand from heat treating means under generally tensionless conditions to a yarn directing means;

(b) oscillating said yarn directing means over a continuously moving yarn support surface to deposit the yarn strand under generally tensionless conditions thereon;

(c) accumulating the yarn on the moving surface while permitting the yarn to cool under substantially tensionless conditions;

(d) withdrawing the yarn strand from the accumulated yarn on the surface in a direction substantially parallel to the surface and to the direction of movement of the accumulated yarn thereon to reduce tendency of the strand to tangle during removal from said surface;

(e) subjecting the moving yarn strand in a confined area to an oppositely directed flow of air under pressure to detangle the same; and (f) taking up the yarn strand on a package at a speed that is controlled by the amount of yarn on said moving surface.

12. A process as defined in claim 11 wherein said surface is an endless conveyor belt that is perforated whereby said accumulated yarn on said moving surface is cooled while residing thereon.

* * * * *